US010599084B2

(12) United States Patent
Miyazaki

(10) Patent No.: US 10,599,084 B2
(45) Date of Patent: Mar. 24, 2020

(54) IMAGE FORMING APPARATUS, IMAGE FORMING METHOD, CONTROL PROGRAM, AND IMAGE FORMATION MANAGEMENT SYSTEM

(71) Applicant: Konica Minolta, Inc., Tokyo (JP)

(72) Inventor: Ken Miyazaki, Kanagawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/466,929

(22) Filed: Mar. 23, 2017

(65) Prior Publication Data

US 2017/0277099 A1 Sep. 28, 2017

(30) Foreign Application Priority Data

Mar. 24, 2016 (JP) ..... 2016-060436

(51) Int. Cl.
*G03G 15/00* (2006.01)

(52) U.S. Cl.
CPC ..... *G03G 15/5095* (2013.01); *G03G 15/5012* (2013.01); *G03G 15/5029* (2013.01); *G03G 15/6517* (2013.01); *G03G 2215/00126* (2013.01)

(58) Field of Classification Search
CPC ..... G03G 15/5095; G03G 15/5012; G03G 15/5029
See application file for complete search history.

(56) References Cited

U.S. PATENT DOCUMENTS 6,582,348 B2 * 6/2003 Bacciottini ..... B31F 1/10 271/10.01
7,272,267 B1 * 9/2007 Nakajima ..... H04N 1/3875 358/450
9,710,734 B2 * 7/2017 Sasami ..... G03G 15/652
2003/0215252 A1 * 11/2003 Yokobori ..... B41J 11/003 399/45
2009/0060610 A1 * 3/2009 Matsuhashi ..... G03G 15/6517 399/395
2010/0304945 A1 * 12/2010 Ang ..... B65H 45/142 493/355
2011/0069986 A1 * 3/2011 Fukasawa ..... G03G 15/231 399/82

(Continued)

FOREIGN PATENT DOCUMENTS

JP H03-95250 U 9/1991
JP H05-138976 A 6/1993

(Continued)

OTHER PUBLICATIONS

Machine translation of Lee (2007).*

(Continued)

*Primary Examiner* — Sevan A Aydin
(74) *Attorney, Agent, or Firm* — Osha Liang LLP

(57) ABSTRACT

An image forming apparatus includes: an image forming unit configured to form an image on a continuous transfer medium on the basis of image data of a job; and a controller configured to manage the job and control the image forming unit, wherein the controller has a function of adjusting an image print position on the continuous transfer medium when a job medium width size specified in the job is different from a fed medium width size used in printing.

9 Claims, 8 Drawing Sheets

(56) References Cited

U.S. PATENT DOCUMENTS

| | | | | |
|---|---|---|---|---|
| 2011/0211857 | A1* | 9/2011 | Mikami | G03G 15/5029 399/82 |
| 2015/0154481 | A1* | 6/2015 | Asai | G03G 15/36 358/1.18 |
| 2015/0370205 | A1* | 12/2015 | Sasami | G03G 15/652 399/38 |
| 2018/0129457 | A1* | 5/2018 | Akiyama | G06F 3/1251 |

FOREIGN PATENT DOCUMENTS

| | | | | |
|---|---|---|---|---|
| JP | 2005078128 | A | | 3/2005 |
| JP | 2012-166439 | A | | 9/2012 |
| JP | 2015-138508 | A | | 7/2015 |
| KR | 20070057570 | A | * | 6/2007 |

OTHER PUBLICATIONS

Notification of Reasons for Refusal issued in Japanese patent Application No. 2016-060436, dated Sep. 10, 2019 (21 pages).

Notice of Reasons for Refusal issued in corresponding Japanese Patent Application No. 2016-060436 dated Nov. 12, 2019 (20 pages).

* cited by examiner

IMAGE FORMING APPARATUS, IMAGE FORMING METHOD, CONTROL PROGRAM, AND IMAGE FORMATION MANAGEMENT SYSTEM

The entire disclosure of Japanese Patent Application No. 2016-060436 filed on Mar. 24, 2016 including description, claims, drawings, and abstract are incorporated herein by reference in its entirety.

BACKGROUND OF THE INVENTION

Field of the Invention

The present invention relates to an image forming apparatus that forms an image on a continuous transfer medium, an image forming method, a control program, and an image formation management system.

Description of the Related Art

A plurality of images is printed on one continuous paper in view of saving printing paper and simplifying a printing process. A representative example of the continuous paper is roll paper.

The continuous paper has a fixed width, within which the plurality of images is printed. However, the size and layout of the images vary among jobs.

JP 2015-138508 A discloses a print control apparatus that can execute image printing with a proper orientation and the smallest number of divisions by a user specifying a finish size and an enlargement ratio.

Moreover, JP 2012-166439 A discloses a device which, in performing a conversion according to the sheet size of print data, acquires an operating state of an engine to perform the conversion according to the size of the sheet set in an image forming apparatus when the engine is in operation, or perform the conversion according to the size of the sheet with which a conveyance distance is reduced when the engine is not in operation, the sheet being used in printing the print data.

JP 2015-138508 A and JP 2012-166439 A both relate to the technique of changing the image size in accordance with the paper width to perform printing.

However, when one wishes to print a label efficiently, he may wish to perform printing without changing the enlargement ratio of the image size or the like. Such a label is printed with a layout in which a margin is removed as much as possible. Accordingly, a roll of label paper with the width of 330 mm or a roll of label paper with the width of 250 mm is used depending on the size and layout of the label, for example. In such a case, the continuous paper set in an image forming apparatus has a desired width. One may however wish to use the continuous paper having different widths in a single image forming apparatus.

When a plurality of labels is printed on the continuous paper with an adhesive surface sandwiched between front and back sheets, an adhesive is sometimes squeezed out of the continuous paper and adheres to a process unit from a transfer unit to a fixing unit of an image forming unit at the time of image formation.

Accordingly, when the continuous paper having different widths is used in the same image forming apparatus, the adhesive being squeezed out can possibly adhere to wide continuous paper when such paper is used. Thus, a user needs to turn off the machine and replace the entire process unit with one adapted for 250 mm, when the continuous paper is to be replaced by the continuous paper having a different width in the same image forming apparatus.

The replacement of the process unit may be required for various other reasons. In the image forming apparatus with a function of saving a job in an HDD or the like, for example, there occurs a mismatch in the paper size when one attempts to execute the saved job after changing the size of the continuous paper subjected to printing. In normal printing using cut paper, the size for a paper feed tray need only be changed, whereas the change in the size of the continuous paper requires the replacement of the process unit.

Therefore, in electrophotography as it stands, one is unwilling to take time to replace the process unit so that the size is fixed to the width of 330 mm, for example. However, the cost can be reduced in some cases by performing printing with the width of 250 mm depending on the size of an image so that, in an instance where a saved job with the width of the continuous paper specified to 250 mm is to be printed on the continuous paper having the width of 330 mm, printing is performed forcibly with the image width of 250 mm.

Mass produced products such as "point stickers" on canned coffees or the like account for the majority of a printed matter created with the continuous paper. Accordingly, the sticker is generally cut out by a die cutter post processor that uses a die cutting a large volume of products at a time rather than a laser cut post processor that cuts products one by one. As a result, a reference cut position of a post processing cutter is misaligned as illustrated in FIG. 8. FIG. 8 illustrates a case where roll paper RPO with the width of 250 mm is printed on roll paper RPl with the width of 330 mm. At this time, an array K of a die cutter is arranged to be aligned with the roll paper RPO with the width of 250 mm, whereas an image position and a cut position are shifted on the roll paper RPl with the width of 330 mm so that the paper is cut to the width of 250 mm in advance by a cutter D or the like before being cut in accordance with specifications of the post processing cutter.

SUMMARY OF THE INVENTION

One or more embodiments of the invention provide an image forming apparatus, an image forming method, a control program and an image formation management system that can set an image forming position on a transfer medium to a predetermined position when a job medium width size specified in a job is different from a fed medium width size used in printing.

According to one aspect of the invention, an image forming apparatus comprises:

an image former (hereinafter image forming unit) configured to form an image on a continuous transfer medium on the basis of image data of a job; and a controller configured to manage the job and control the image forming unit, wherein the controller has a function of adjusting an image print position on the continuous transfer medium when a job medium width size specified in the job is different from a fed medium width size used in printing.

When adjusting the image print position, the controller may perform control to print an image of the job, in which the job medium width size is specified, on paper having the fed medium width size.

The controller may adjust the image print position when the job medium width size is smaller than the fed medium width size.

The image forming apparatus may further comprise an operation display section configured to be controlled by the controller and accept an operational input, and the controller may operably display, on the operation display section, an item for setting the image print position on a transfer medium when the job medium width size is smaller than the fed medium width size.

The controller may adjust the image print position in a manner that an image is right-justified or left-justified in a width direction on the continuous transfer medium.

The controller can adjust the image print position to any position in a width direction.

The controller may cancel printing or provides a notification urging one to cancel printing when the job medium width size is larger than the fed medium width size.

The controller may cancel printing or provides the notification when an image forming width of a job is larger than a width within which an image can be printed of the fed medium width size.

When adjusting the image print position for a job medium width size of any of a plurality of jobs having different job medium width sizes, the controller may apply the adjustment of the image print position similarly to a job having the same job medium width size as that subjected to the adjustment.

When adjusting the image position in a top job with a job medium width size among the plurality of jobs having the different job medium width sizes, the controller may apply the adjustment of the image print position similarly to a job in which the job medium width size different from a fed medium size is specified.

The controller may manage transfer medium information in which the fed medium width size is set.

The job may be to cut an image by a cutter after image formation.

The image forming apparatus may further comprise a cutter.

According to another aspect of the invention, an image forming method forms an image on a continuous transfer medium on the basis of image data of a job, and comprises:

a step of adjusting an image print position on the continuous transfer medium when a job medium width size specified in the job is different from a fed medium width size used in printing.

The step of adjusting the image print position may be performed when the job medium width size is smaller than the fed medium width size.

Printing may be canceled or a notification is provided when an image forming width of a job is larger than a width within which an image can be printed of the fed medium width size.

According to another aspect of the invention, a non-transitory recording medium storing a computer readable control program is executed by an image forming apparatus that forms an image on a continuous transfer medium on the basis of image data of a job or by a management device that manages the image forming apparatus, and the program comprises:

a step of adjusting an image print position on the continuous transfer medium when a job medium width size specified in the job is different from a fed medium width size used in printing.

The step of adjusting the image print position may be performed when the job medium width size is smaller than the fed medium width size.

The program may further comprise a step of canceling printing or providing a notification when an image forming width of a job is larger than a width within which an image can be printed of the fed medium width size.

According to another aspect, an image formation management system manages an image forming apparatus forming an image on a continuous transfer medium on the basis of image data of a job, and the system comprises:

a management control unit configured to manage the image forming apparatus, wherein the management control unit performs control to adjust an image print position on the continuous transfer medium when a job medium width size specified in the job is different from a fed medium width size used in printing.

The management control unit may perform the control to adjust the image print position when the job medium width size is smaller than the fed medium width size.

The management control unit may perform control to cancel printing or provide a notification when an image forming width of a job is larger than a width within which an image can be printed of the fed medium width size.

BRIEF DESCRIPTION OF THE DRAWINGS

The above and other advantages and features of the present invention will become more fully understood from the detailed description given hereinbelow and the appended drawings which are given by way of illustration only, and thus are not intended as a definition of the limits of the present invention, and wherein.

DESCRIPTION OF THE EMBODIMENTS

Hereinafter, embodiments of the present invention will be described with reference to the drawings. However, the scope of the invention is not limited to the illustrated examples.

Figure 1:
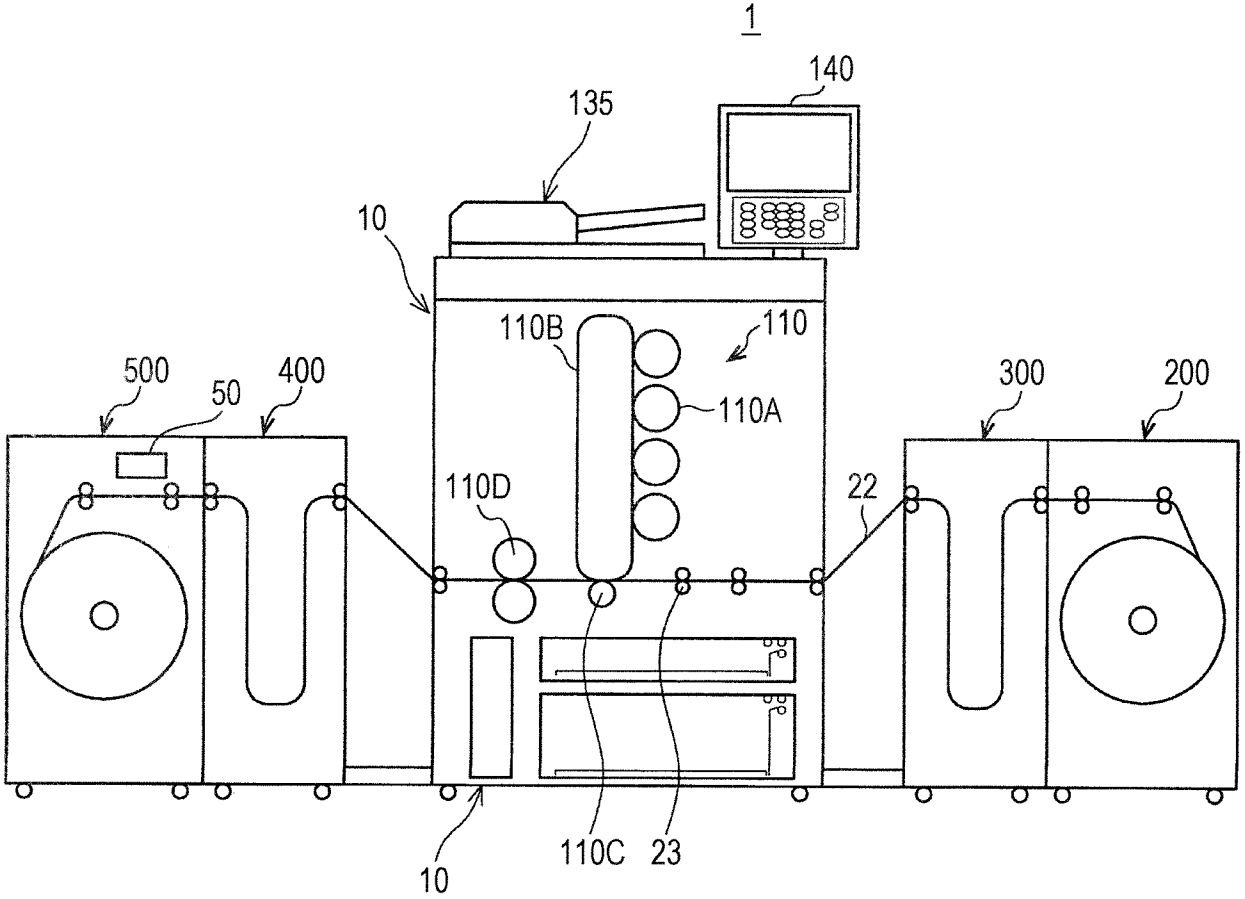
FIG. 1 is a diagram illustrating a mechanical schematic of an image forming apparatus according to one or more embodiments of the present invention.

FIG. 1 is a diagram illustrating a mechanical schematic of an image forming apparatus 1 according to one or more embodiments of the present invention.

The image forming apparatus 1 includes an image forming apparatus body 10 including an image forming unit, a paper feed adjustment unit 300 connected to an upstream side of the image forming apparatus body 10, and a paper feed unit 200 connected to an upstream side of the paper feed adjustment unit 300. A paper ejection adjustment unit 400 is connected to a paper ejecting side of the image forming apparatus body 10, and a paper ejection unit 500 is connected to a paper ejecting side of the paper ejection adjustment unit 400. The image forming unit is installed in the image forming apparatus body 10 as described later. A cutter 50 is provided in the paper ejection unit 500 in this example. The cutter 50 may be arranged at any position after image formation and may be provided as a unit independent of the image forming apparatus. The cutter 50 included in the image forming apparatus 1 may instead be provided separately from the image forming apparatus 1.

In one or more embodiments, the image forming apparatus 1 is made up of the image forming apparatus body 10 and a device connected to the image forming apparatus body 10. However, the type and the number of devices connected to the image forming apparatus body 10 are not particularly limited. Alternatively, the image forming apparatus may be formed of only the image forming apparatus body 10.

The paper feed unit 200 has a function of storing, keeping and feeding roll paper used as continuous paper. The paper feed adjustment unit 300 has a buffer function that smooths out a subtle speed difference and offset between the paper feed unit 200 and the image forming apparatus body 10. The paper ejection adjustment unit 400 has a buffer function that smooths out a subtle speed difference and offset between the image forming apparatus body 10 and the paper ejection unit 500.

The paper ejection unit 500 includes the cutter 50 for cutting roll paper RP, which is cut by the cutter 50 as needed, taken up around a roll and kept.

While the roll paper is used as the continuous paper in the above examples, the continuous paper is not limited to the roll paper but may be any paper that is continuous including continuous slip paper and continuous form paper. The continuous paper may be provided while being rolled up like the roll paper or fan folded. The continuous paper corresponds to a continuous transfer medium. The continuous transfer medium is not limited to paper but can be made of an appropriate material such as cloth or a plastic film.

The image forming apparatus body 10 includes therein an image forming unit 110 that forms an image on paper, and an operation display section 140 that accepts an operation from an operator and displays information is provided on the upper side of the image forming apparatus body 10. The operation display section 140 may be configured to include an operation unit performing an operation and a display unit performing display as separate units, or include the operation unit and the display unit in one unit such as a touch panel LCD.

Moreover, a document reading unit 135 including an automatic document feeder that automatically reads a document is provided at the top of the image forming apparatus body 10, where an image on a document is read by the document reading unit 135 and temporarily recorded in an image memory or the like not shown. The image being read is used in image formation performed by the image forming unit 110.

The image forming apparatus 1 includes a conveyance path 22 extending from the paper feed unit 200, the paper feed adjustment unit 300 to the image forming unit 110, and from the image forming unit 110, the paper ejection adjustment unit 400 to the paper ejection unit 500.

The conveyance path 22 is provided with a plurality of rollers such as conveyor rollers 23 to feed and convey paper.

The conveyance path 22, the conveyor rollers 23 and a motor (not shown) driving the roller that is rotationally driven make up a continuous paper conveying unit according to one or more embodiments of the present invention.

The roll paper stored in the paper feed unit 200 is fed through the conveyance path 22 and reaches the image forming unit 110. The roll paper is conveyed to a secondary transfer roller 110C through the conveyor rollers 23. Note that a process unit includes the conveyance path 22 and the conveyor rollers 23 provided between the secondary transfer roller 110C and a fixing unit 110D.

The image forming unit 110 includes a photoreceptor 110A provided for each color (including cyan, magenta, yellow and black), and a charging unit, a write unit and a developing unit that are not shown are arranged along the circumference of each photoreceptor 110A. A surface of the photoreceptor charged by the charging unit is subjected to image exposure in the write unit such as an LD on the basis of image information on a document recorded in a storage such as an image memory, whereby a latent image is formed on the surface of the photoreceptor 110A. The latent image is developed by the developing unit to be a toner image. The toner image is transferred onto an intermediate transfer belt 1103, then the image on the intermediate transfer belt 110B is transferred onto the roll paper that is conveyed through the conveyance path 22 while being pressed by the secondary transfer roller 1100. While a color image forming apparatus including the photoreceptor 110A for each color and the intermediate transfer belt 110B is described above, the image forming apparatus may instead by a monochrome image forming apparatus.

The image forming unit 110 having the intermediate transfer belt 110B in contact with each of the photoreceptors 110A further includes a cleaning unit (not shown) that is in contact with each of the photoreceptors 110A to remove residual toner at a position forward in the direction of rotation relative to the contact position between the belt and each of the photoreceptors 110A and backward in the direction of rotation relative to the charging unit. Another cleaning unit (not shown) for removing residual toner on the intermediate transfer belt 110B is arranged at a position forward in the direction of rotation relative to a paper transfer position of the intermediate transfer belt 110B and backward in the direction of rotation relative to a transfer position between the belt and each of the photoreceptors.

Note that each of the aforementioned photoreceptors 110A is rotationally driven by a drive motor not shown, and so is the intermediate transfer belt 110B rotationally driven by a drive motor not shown.

The paper onto which the image is transferred by the secondary transfer roller 110C is heated and pressured while being pressed and conveyed by a fixing roller of the fixing unit 110D, so that the toner image on the paper is fixed and that the paper is ejected to the outside of the image forming apparatus body 10.

After the roll paper is ejected from the image forming apparatus body 10, a subtle speed difference and offset between the paper ejection unit 500 and the image forming apparatus body 10 are smoothed out by the paper ejection adjustment unit 400, then the paper reaches the paper ejection unit 500.

In the paper ejection unit 500 including the cutter 50 for cutting the roll paper, the cutter 50 performs cutting on an image that requires cutting, the image being repeatedly printed according to a predetermined cycle by the image forming unit 110. Note that the shape and setting of the cutter 50 are adapted for the cycle so that cutting can be performed successively on the image printed repeatedly.

Figure 2:
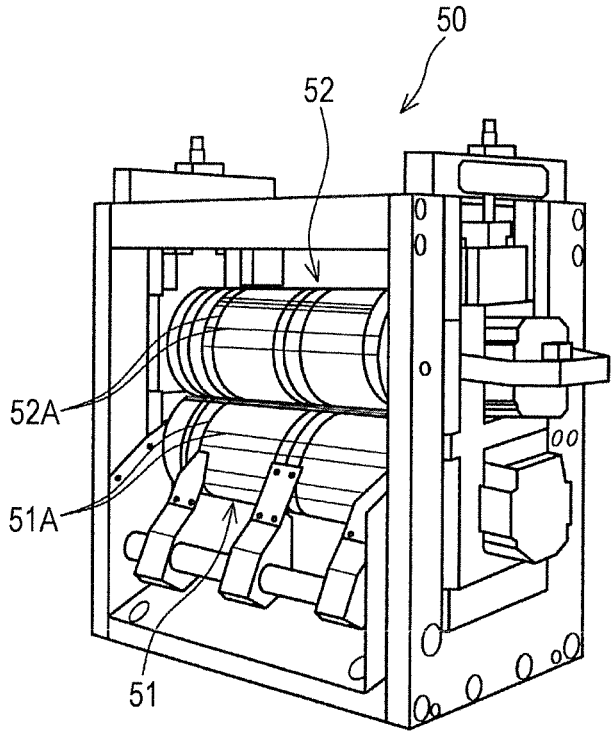
FIG. 2 is a perspective view of a cutter according to one or more embodiments of the present invention.

FIG. 2 illustrates a schematic structure of the cutter 50.

The cutter 50 includes a lower roll 51 having a lower cutting line 51A and an upper roll 52 having an upper cutting line 52A, where the cutting lines are superposed in synchronization with each other when the lower roll 51 and the upper roll 52 are rotated in mutually opposite directions. The cutting lines may be formed such that one of the cutting lines is a protrusion while the other cutting line is a groove. The structure of the cutter is not particularly limited, and may include one using a laser or the like.

Figure 3:
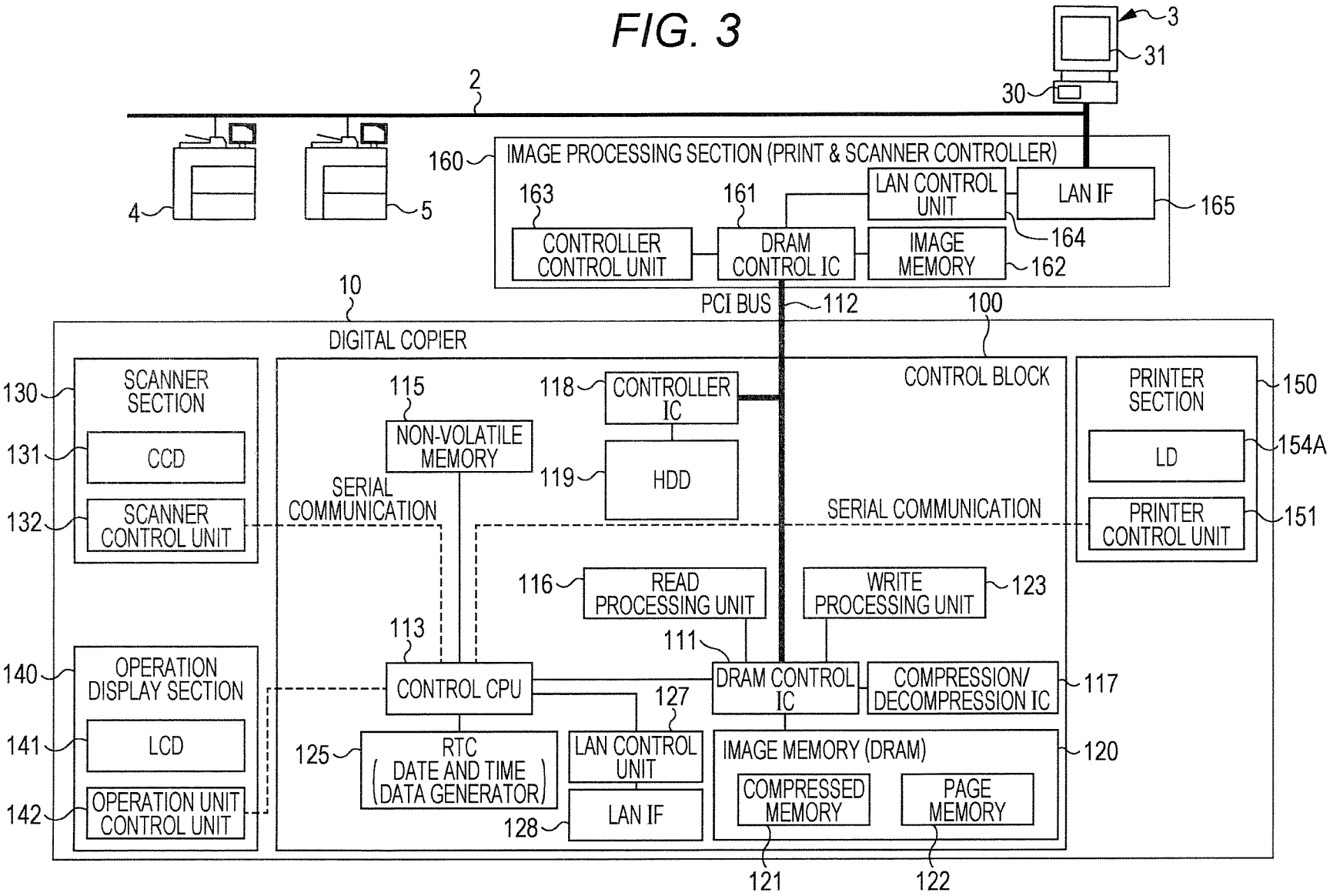
FIG. 3 is an electrical block diagram of an image forming system including the image forming apparatus according to one or more embodiments of the present invention.

Next, the image forming apparatus 1 will be described in terms of its function on the basis of a block diagram illustrated in FIG. 3.

The image forming apparatus 1 includes as a main structure a digital copier including a control block 100, a scanner section 130, the operation display section 140 and a printer section 150, as well as an image processing section (print and scanner controller) 160 that processes image data input/output to/from an external device 3 via a network 2.

The control block 100 includes a PCI bus 112, which is connected to a DRAM control IC 111 within the control block 100. The PCI bus 112 is further connected to an HDD 119 via a controller IC 118. The HDD 119 can store image data and a job including image data.

The control block 100 also includes a control CPU 113 which is connected to the DRAM control IC 111. The control CPU 113 is also connected to a non-volatile memory 115. The non-volatile memory 115 stores a program executed by the control CPU 113, setting data for the image forming apparatus 1, a process control parameter, the width of the continuous transfer medium to be used in printing, an image print position that can be set when a job medium width size specified in a job is different from a fed medium width size used in printing, and image print position information corresponding to the job medium width size.

The control CPU 113 is configured to control the entire image forming apparatus 1 by executing a program and grasp the status of the entire image forming apparatus 1, and performs control such as roll paper conveyance control, image processing control and image formation control. That is, the control CPU 113, the program running in the control CPU 113, the non-volatile memory 115 and the like make up a controller in one or more embodiments of the present invention.

The control CPU 113 is connected to an RTC (date and time data generator) 125, which can transmit date and time data to the control CPU 113.

The scanner section 130 includes a CCD 131 performing optical reading and a scanner control unit 132 controlling the entire scanner section 130. The scanner control unit 132 is connected to the control CPU 113 to be able to perform serial communication therewith, and is controlled by the control CPU 113. Note that the scanner control unit 132 can be formed of a CPU and a program operating it. Image data read by the CCD 131 is subjected to data processing in a read processing unit 116. The read processing unit 116 is connected to the DRAM control IC 111.

The operation display section 140 includes a touch panel LCD 141 and an operation unit control unit 142 that are connected to each other, where the operation unit control unit 142 and the control CPU 113 are connected to be able to perform serial communication with each other. Such a structure allows the control CPU 113 to control the operation display section 140. Note that the operation unit control unit 142 can be formed of a CPU and a program operating it.

The operation display section 140 performs various settings on the image forming apparatus body 10 and the paper feed unit 200 so that the controller controls image formation and roll paper conveyance on the basis of the settings.

One can input a setting and an operation control condition such as an operation command for the image forming apparatus 1 to the operation display section 140, which can display settings, the status of the machine and information and is controlled by the control CPU 113. A predetermined operation can be performed by the operation display section 140. The operation display section can, for example, perform setting and displaying of the image print position that are controlled by the control CPU 113 according to one or more embodiments of the present invention as well as provide a notification urging one to cancel a job when the job medium width size is larger than the fed medium width size.

The DRAM control IC 111 is connected to an image memory 120 including a compressed memory 121 and a page memory 122. The image memory 120 stores the image data acquired by the scanner section 130 and image data acquired through the network 2. The image memory 120 thus serves as a storage area for the image data and stores image data of a job to be printed. The DRAM control IC 111 can also cause the image memory 120 to store image data of a plurality of jobs. That is, the image memory 120 can store image data of a reserved job. The image data can also be stored in the HDD 119.

The DRAM control IC 111 is connected to a compression/decompression IC 117 that compresses image data or decompresses the compressed data. The DRAM control IC 111 is also connected to a write processing unit 123. The write processing unit 123 is connected to an LD 154A of the printer section 150 and processes data used in the operation of the LD 154A. The LD 154A is a collective term for an LD of each color. The printer section 150 controls the image forming unit 110 and a conveying unit including the conveyance path 22.

The printer section 150 includes a printer control unit 151 that controls the entire printer section 150, the printer control unit 151 being connected to the control CPU 113 and controlled thereby. That is, the printer control unit starts or stops a print operation according to a parameter given by the control CPU 113. The printer control unit 151 is connected to a roll feed control unit (not shown) of the paper feed unit 200 and a paper ejection control unit (not shown) of the paper ejection unit 500 to be able to control the control units, where conveyance and take-up of the roll paper can be controlled through the printer control unit 151 while receiving a command from the control CPU 113.

A DRAM control IC 161 of the image processing section (print and scanner controller) 160 is connected to the PCI bus 112 that is connected to the DRAM control IC 111. An image memory 162 is connected to the DRAM control IC 161 in the image processing section (print and scanner controller) 160. Moreover, in the image processing section (print and scanner controller) 160, the DRAM control IC 161 is connected to a controller control unit 163 as well as a LAN control unit 164 and a LAN interface 165. The LAN interface 165 is connected to the network 2.

The external device 3 and other image forming apparatuses 4 and 5 are connected to the network 2 to be able to transmit and receive image data to/from the image forming apparatus 1.

The control CPU 113 is further connected to a LAN control unit 127 and a LAN interface 128 to which the network 2 or another network can be connected. The external device 3 may be connected to the network 2.

The external device 3 can be used as a terminal or a device managing the image forming apparatus. The external device 3 includes an external device control unit 30, the operation of which controls the entire external device 3. When the image forming apparatus 1 is to be controlled by the external device 3, the external device control unit 30 functions as a management control unit according to one or more embodiments of the present invention. The external device control unit 30 can be formed of a CPU, a program operating it and a storage. In this case, the external device control unit 30 can function as an image forming system managing the image forming apparatus. Note that the network 2 may be used as not only a LAN but also a WAN.

The management device may control the image forming apparatus directly or perform control by giving a command including details of control to the image forming apparatus, which is operated according to the command.

Moreover, the notification that urges one to cancel a job may be provided to the external device 3 or an operation display 31 included in the external device 3 by the management control unit of the external device 3.

Next, a basic operation of the image forming apparatus 1 will be described.

A procedure for accumulating image data in the image forming apparatus 1 will be described first. When an image on a document is read by the scanner section 130 to generate image data, the image on the document is optically read by the CCD 131 of the scanner section 130. At this time, the operation of the CCD 131 is controlled by the scanner control unit 132 receiving a command from the control CPU 113. The image read by the CCD 131 is subjected to data processing in the read processing unit 116, then the processed image data is compressed by a predetermined method in the compression/decompression IC 117 to be stored in the compressed memory 121 and/or the HDD 119 via the DRAM control IC 111. The image data stored in the compressed memory 121 and/or the HDD 119 can be managed as a job by the control CPU 113.

On the other hand, image data acquired from outside such as the external device 3 or the other image forming apparatuses 4, 5 via the network 2 passes through the LAN interface 165 and the LAN control unit 164 to be stored in the image memory 162 by the DRAM control IC 161 that is controlled by the controller control unit 163. The data in the image memory 162 passes through the DRAM control IC 161, the PCI bus 112, and the DRAM control IC 111 to be temporarily stored in the page memory 122. The data stored in the page memory 122 is sequentially transmitted to the compression/decompression IC 117 through the DRAM control IC 111 and compressed, then stored in the compressed memory 121 and/or the HDD 119 through the DRAM control IC 111 to be managed by the control CPU 113 as described above.

When the image forming apparatus 1 performs image output, namely when the apparatus is used as a copier or printer, the image data stored in the compressed memory 121 and/or the HDD 119 is sent out to the compression/decompression IC 117 through the DRAM control IC 111 to be expanded, so that the expanded data is repeatedly expanded into the LD 154A by the write processing unit 123 to be able to be printed on the roll paper RP.

When the apparatus is used as the copier, a notification of information such as a print condition (print mode) set in the operation display section 140 is made so that the control CPU 113 creates setting information. The setting information being created can be stored in a RAM of the control CPU 113.

When the apparatus is used as the printer, the print condition can be set in a printer driver in the external device 3. The print condition being set passes through the external device 3, the LAN IF 165, the image memory 162, the DRAM control IC 161 (controller) and the DRAM control IC ill (body) to be stored in the page memory 122, as is the case with the image.

Moreover, in the printer section 150, the printer control unit 151 receiving a command from the control CPU 113 performs control on each unit.

When the image forming apparatus 1 performs image output, the print condition is set through the operation display section 140 to allow the control CPU 113 to control printing according to the setting. The print condition can include the job medium width size and margin setting. In the image forming unit 110, a toner image drawn on each photoreceptor 110A is transferred onto the intermediate transfer belt then to the roll paper RP fed by the paper feed unit 200 by the secondary transfer roller, and is fixed by the fixing unit. The paper with the image formed thereon is conveyed to the paper ejection adjustment unit 400 through the conveyance path 22. When a plurality of jobs is reserved, the image output is performed one by one according to order being set.

Figure 4:
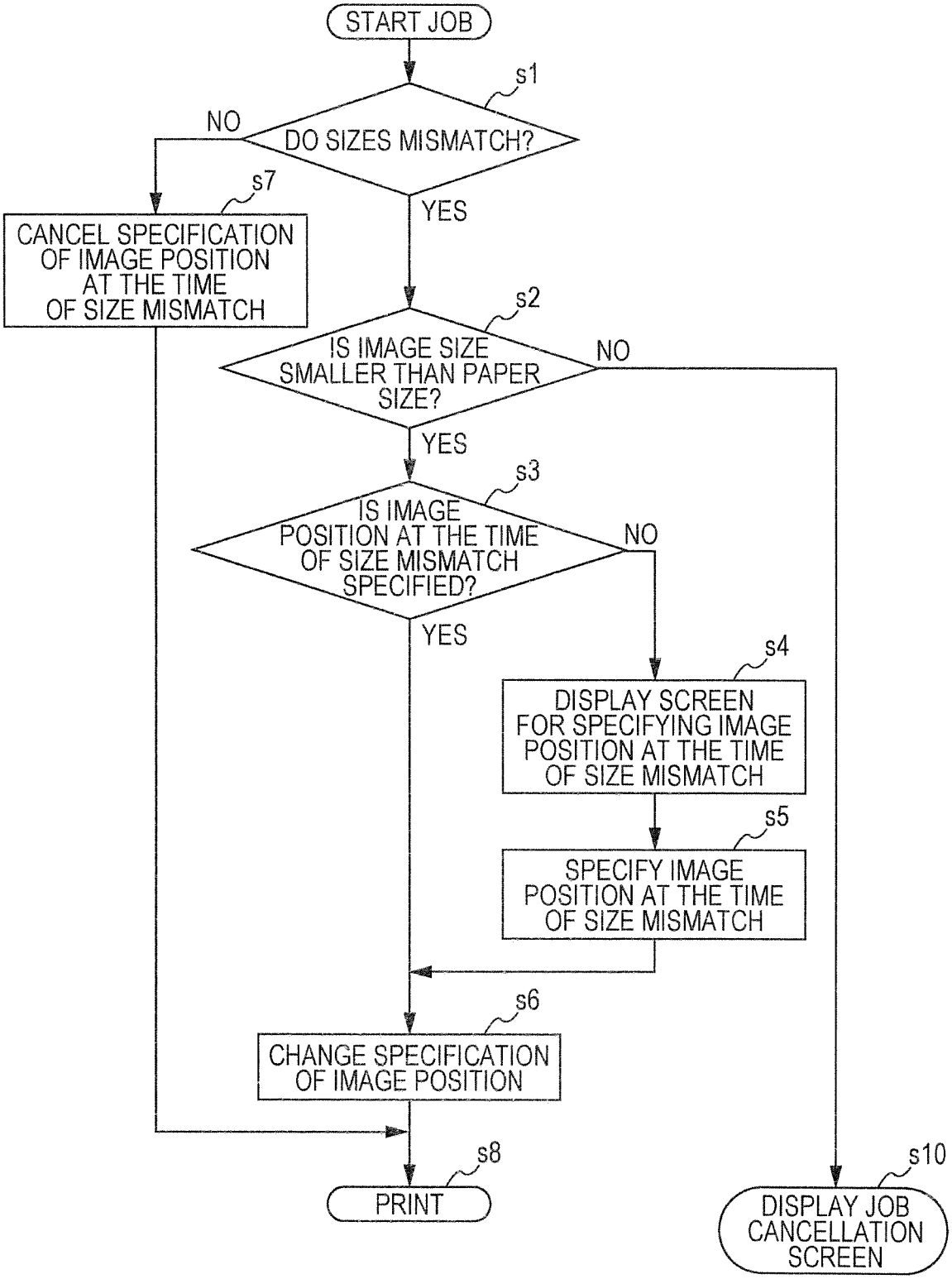
FIG. 4 is a flowchart illustrating a procedure by which processing proceeds according to a match or mismatch between a job medium width size specified in a job and a fed medium width size used in printing, according to one or more embodiments of the present invention.

A procedure performed when the job medium width size specified in the job is different from the fed medium width size used in printing will now be described on the basis of a flowchart in FIG. 4. The following procedure is executed while being controlled by the controller or the management control unit.

With a start of a job, it is determined whether the job medium width size specified in the job does not match the fed medium width size used in printing. The job medium width size specified in the job is included in the print condition for the job or the like and known by the controller. The fed medium width size used in printing is set in advance via the operation display section 140 or the operation display 31 and stored in the non-volatile memory, for example. A default may be set when only one size is available as the fed medium width size. Alternatively, the controller may use an appropriate sensor or the like to know the fed medium width size on the basis of a sensing result.

The job medium width size specified in the job matches the fed medium width size used in printing when it is determined that the sizes do not mismatch (No in step s1), so that specification of an image position (image print position) at the time of size mismatch is canceled (step s7) to execute printing (step s8).

When the job medium width size specified in the job does not match the fed medium width size used in printing (Yes in step s1), it is determined whether an image size (image forming size) is smaller than a paper size (image forming paper size) (step s2). A job cancellation screen is displayed (step s10) when the image size is not smaller than the paper size (No in step s2). The job cancellation screen may provide a notification that the job is canceled or provide a cancellation instruction after user confirmation.

When the image size is smaller than the paper size (Yes in step s2), it is determined whether the image position at the time of size mismatch is specified (step s3). Note that when the image size is identical to the paper size, processing may be performed as when the image size is smaller than the paper size.

When the image position at the time of size mismatch is not specified (No in step s3), a screen for specifying the image position at the time of size mismatch is displayed (step s4). Next, the specification of the image position at the time of size mismatch set by the user is accepted (step s5).

When the image position at the time of size mismatch is specified (Yes in step s3) or after step s5, the specification of the image position is changed (step s6) to execute printing (step s8).

With the aforementioned procedure being executed, the width of the roll paper need not be cut after printing to be able to eliminate a mistake in the operation or the operation time. Moreover, the same cutter can be used when the job medium size is different so that a die need not be manufactured unnecessarily and that a production cost can be reduced.

Note that at the time of changing the specification of the image position, a piece of data in which the job medium width size is associated with the image print position is stored in the non-volatile memory or the like. Accordingly, the associated data being stored may be read to perform the specification of the image print position automatically when a job with the job medium width size identical to the job medium width size being stored is to be printed. It may also be adapted to set whether to perform the specification automatically when the associated data is stored.

This saves the trouble of selecting the print position in each job to thus improve operability. Moreover, when the print position being stored can be used, the image print position being stored may be used to perform the specification automatically even at the time of printing a job with the job medium width size different from the job medium width size being stored.

Figure 5:
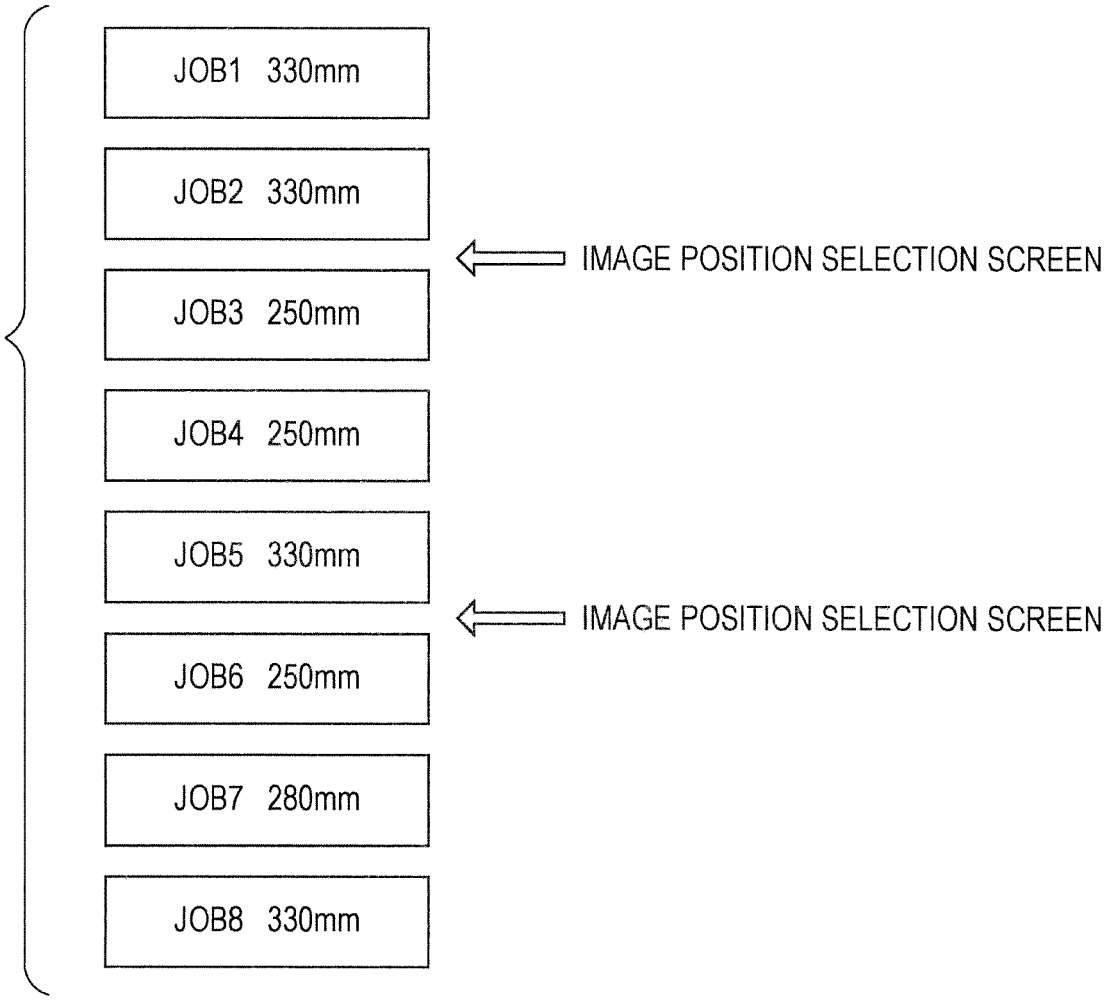
FIG. 5 is a diagram illustrating an adjustment of an image print position based on printing performed by a plurality of jobs having different job medium width sizes, according to one or more embodiments of the present invention.

FIG. 5 will be referenced to describe an image of how the aforementioned procedure is executed by a plurality of jobs having different job medium width sizes.

In this example, it is assumed that the roll paper with the fed medium width size of 330 mm is set in the image forming apparatus.

When JOBS 1 and 2 with which the job medium width size of 330 mm is specified are executed successively, the image print position is not specified since the job medium width size matches the fed medium width size used in printing. The specification of the image print position at the time of size mismatch is canceled when the image print position is specified before printing is performed with the fed medium width size.

In JOB 3, printing is executed with the specified job medium width size of 250 mm different from the fed medium width size, whereby an image position selection screen is displayed to allow for specification of the image print position.

The image print position previously specified is left unchanged when a job with the same size succeeds.

When a job in which the job medium width size identical to the fed medium width size is specified is thereafter executed after a change in the job medium width size, the specification of the image print position is canceled.

After that, when a job with the job medium width size of 250 mm is further executed, the image position selection screen is displayed to allow for an adjustment of the image print position. When a job with the job medium width size different from the fed medium width size is thereafter executed after the different job medium width size is specified, the image print position may be used as is or the image print position selection screen may be displayed to allow for specification of the image print position. After that, when a job in which the job medium width size identical to the fed medium width size is specified is executed after a change in the job medium width size, the specification of the value of the image print position is canceled.

Figure 6:
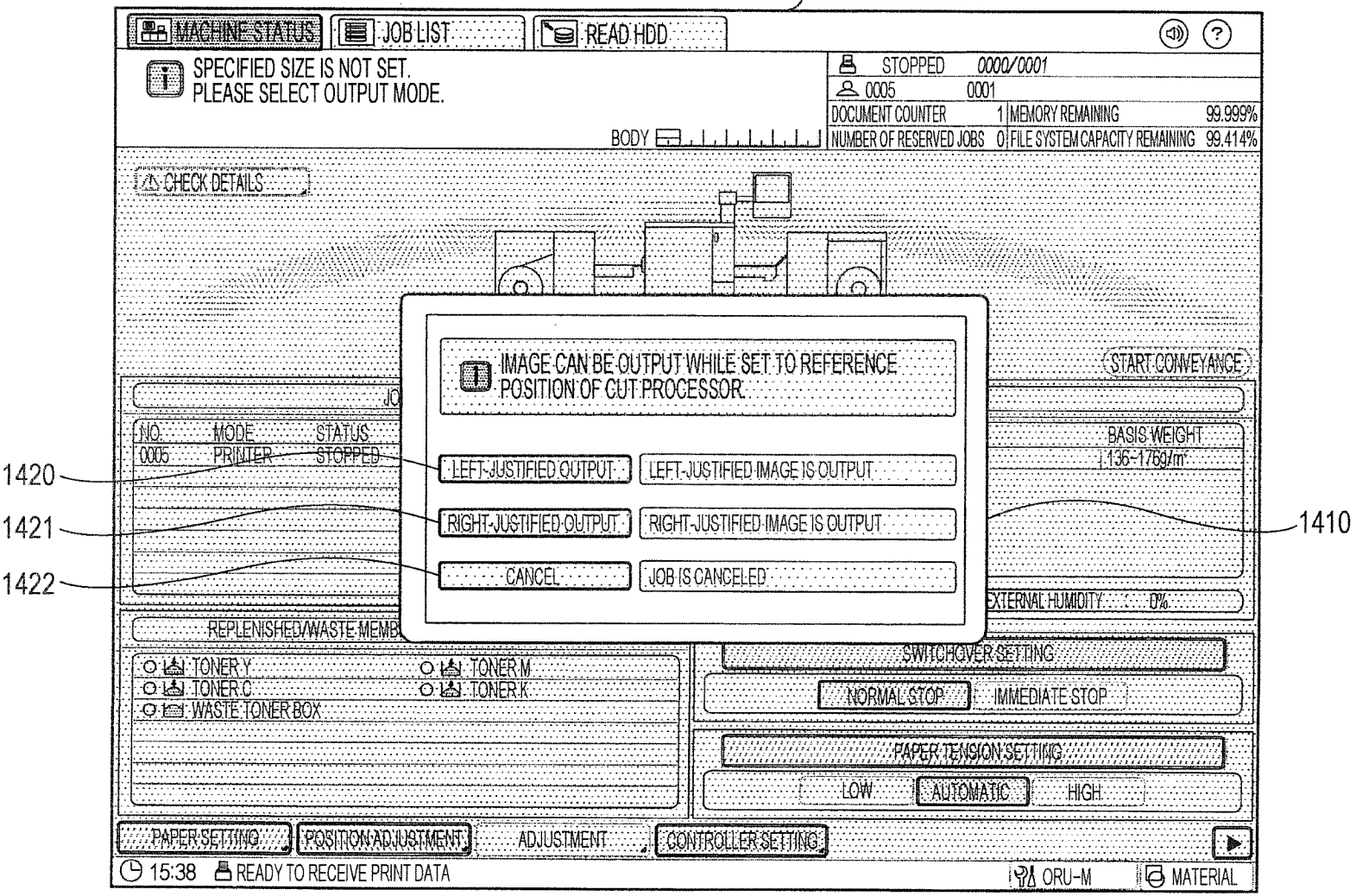
FIG. 6 is a diagram illustrating an image print position adjustment screen according to one or more embodiments of the present invention.

An example of the image print position selection screen is illustrated in FIG. 6.

In this example, a pop-up image print position selection screen 1410 is displayed in a machine setting screen 1400. The image print position selection screen need not be displayed as a pop-up but may be displayed upon transition from another screen.

When the image forming apparatus is managed by the management device, the screen may be displayed on the operation display 31 of the external device 3 to be operable thereby, for example.

The image print position selection screen 1410 displays a left-justified output button 1420, a right-justified output button 1421 and a cancel button 1422 which be pressed as operation items adjusting the image print position.

When the left-justified output button 1420 is pressed, the image print position is set to a left-justified position on the roll paper with the fed medium width size.

When the right-justified output button 1421 is pressed, the image print position is set to a right-justified position on the roll paper with the fed medium width size.

When the cancel button 1422 is pressed, the setting on a current screen is canceled. An OK button or the like may be provided for a confirmation of the selection of a button, or the output button may be pressed a second time to confirm the setting.

Note that the image print position may be set according to only a predetermined setting on the image print position selection screen, where a numeric keypad may be displayed to enable image formation at an arbitrary position in the width direction, for example.

Note that while the job medium size is smaller than the fed medium size in the aforementioned description, the image print position can be adjusted when the job medium size is larger than the fed medium size and can be printed.

Alternatively, it may be adapted to cancel printing when the job medium size is larger than the fed medium size or when the job medium size is larger than the fed medium size with an image region of the job being larger than an image formable region on the roll paper subjected to printing.

Figure 7:
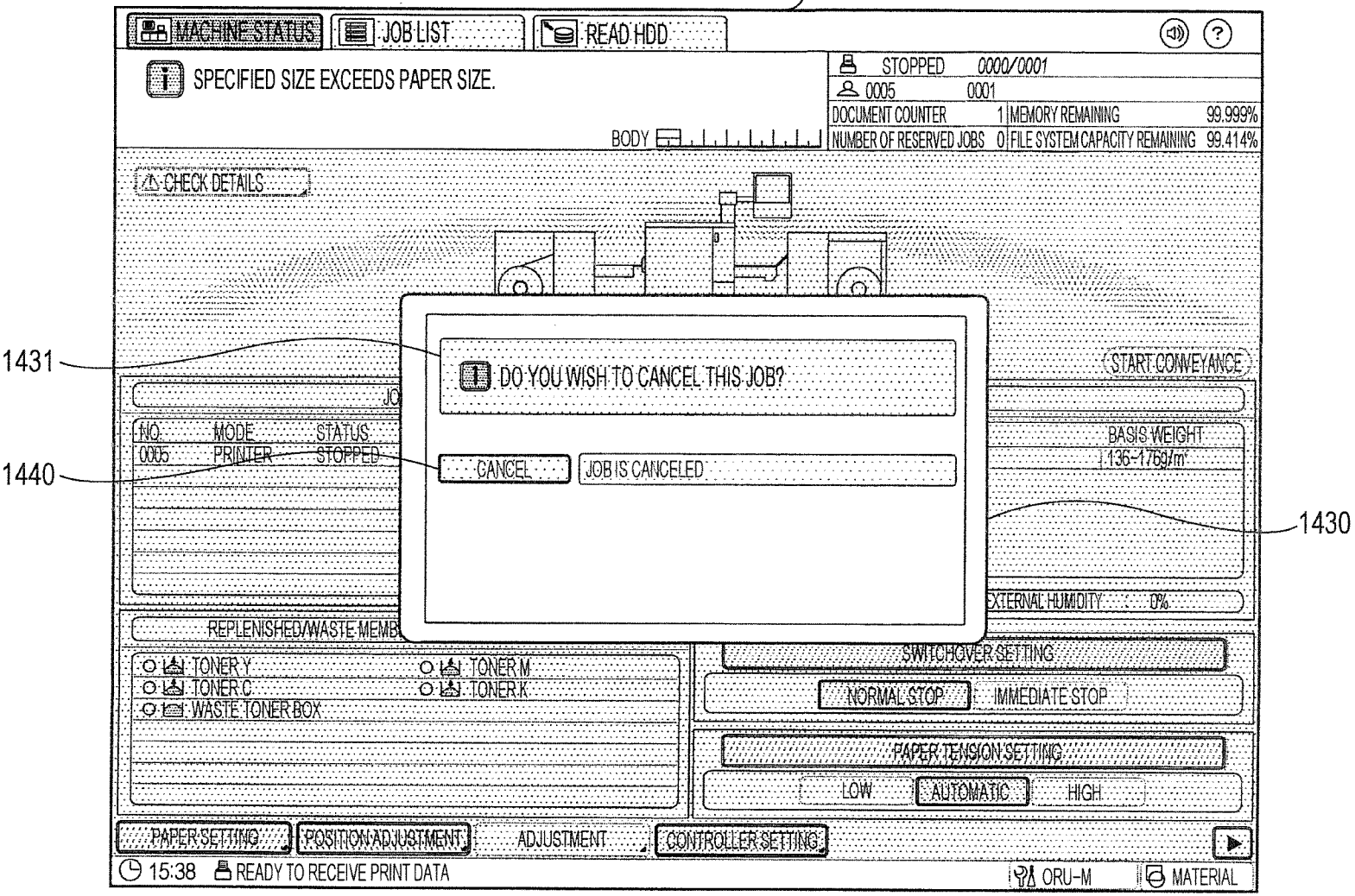
FIG. 7 is a diagram illustrating a job cancellation inquiry screen according to one or more embodiments of the present invention.
Figure 8:
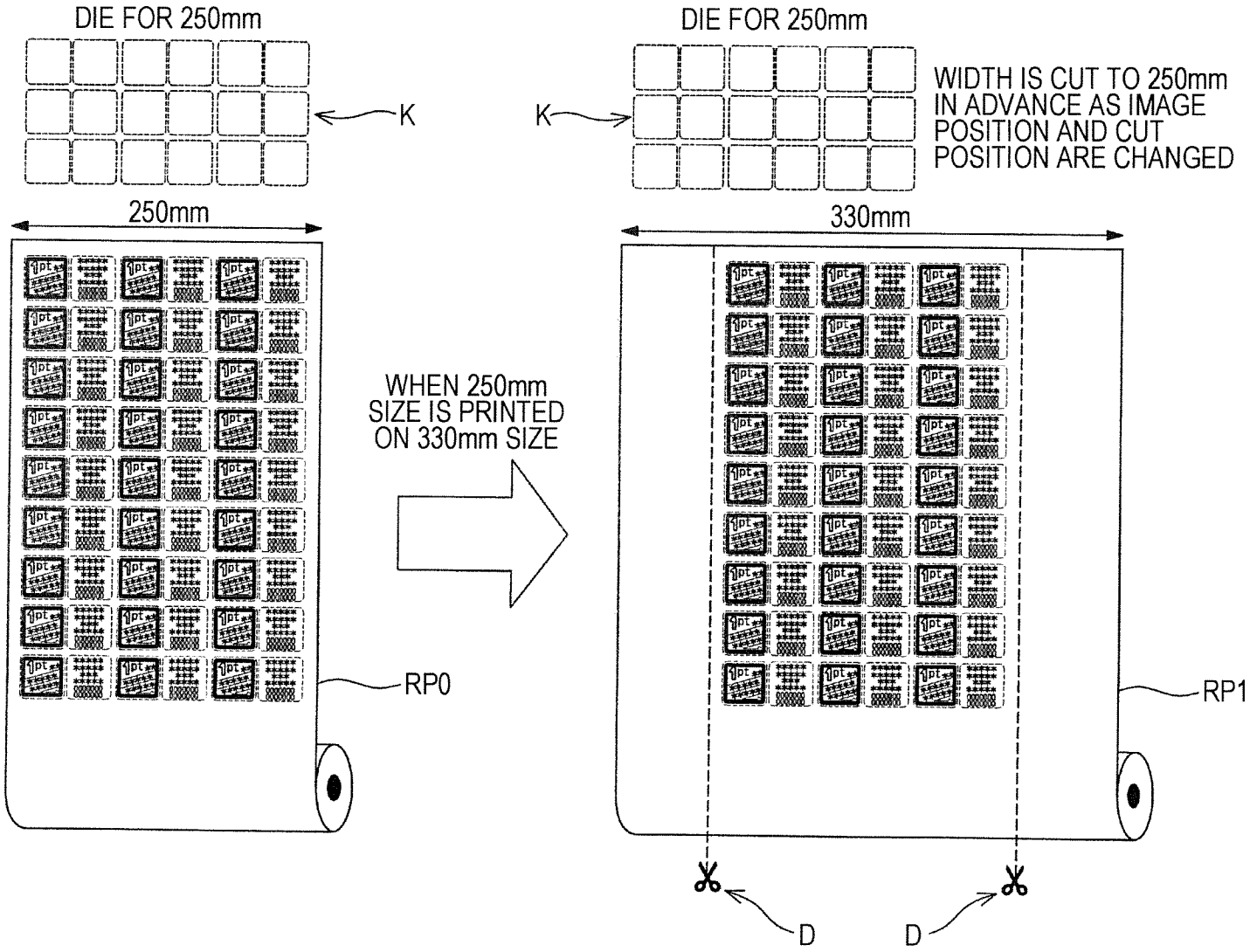
FIG. 8 is a diagram illustrating a situation when a transfer medium with a different fed medium size is set in an image forming apparatus, according to a related art.

FIG. 7 is a diagram of a pop-up cancellation inquiry screen 1430 displayed on the machine setting screen 1400, the cancellation inquiry screen being provided to cancel a job. The cancellation inquiry screen 1430 displays a display 1431 asking whether to cancel a job, and a cancel button 1440 that can be pressed. Printing of a target job is canceled when the cancel button 1440 is pressed. It may be adapted to erase the job at this time. That is, the cancellation inquiry screen corresponds to one notification urging one to cancel a job.

Note that while the cancellation inquiry is made to a user in the aforementioned description, it may be adapted to cancel printing of a job automatically and notify the operation display section 140 and/or the operation display 31 that the printing is canceled, when the job medium size is larger than the fed medium size or when the job medium size is larger than the fed medium size with the image region of the job being larger than the image formable region on the roll paper subjected to printing.

The notification may be notified to a manager by sending thereto a message such as an e-mail.

Although the present invention has been described on the basis of the above embodiments, modifications can be made to the embodiments as appropriate without departing from the scope of the present invention.

According to one or more embodiments of the present invention, a job with the job medium width size different from the fed medium width size can be printed at the predetermined position on the continuous transfer medium, whereby the operations before and after printing can be skipped or simplified.

Although the present invention has been described and illustrated in detail, it is clearly understood that the same is by way of illustrated and example only and is not to be taken by way of limitation, the scope of the present invention being interpreted by terms of the appended claims.

What is claimed is:

1. An image forming apparatus comprising:

an image former that forms an image on a continuous transfer medium on the basis of image data of a job;

a controller that manages the job and controls the image former; and an operation display controlled by the controller and that accepts an operational input, wherein the controller compares a job medium width size specified in the job with a fed medium width size used in printing, when the controller determines that the job medium width size is smaller than the fed medium width size based on the result of the comparison, the controller displays a setting screen including an item for setting an image print position on the continuous transfer medium on the operation display, and adjusts the image print position to any of a plurality of positions in a width direction on the continuous transfer medium based on the operational input, when adjusting the image print position, the controller causes the image former to print, on paper having the fed medium width size, the image of the job in which the job medium width size is specified, when the controller determines that the job medium width size is larger than the fed medium width size based on the result of the comparison, the controller cancels printing of the job and erases the job, and the controller:

after displaying the setting screen on the operation display and setting the image print position, causes the image former to form the image based on the job that specifies the job medium width size smaller than the fed medium width size, and after forming the image based on the job that specifies the job medium width size smaller than the fed medium width size, causes the image former to form, without displaying the setting screen, another image based on another job that specifies a job medium width size that is same as the fed medium width size or same as the job medium width size specified in an immediately previous job.

2. The image forming apparatus according to claim 1, wherein the controller adjusts the image print position in a manner that an image is right-justified or left-justified in a width direction on the continuous transfer medium.

3. The image forming apparatus according to claim 1, wherein, when adjusting the image print position for a job medium width size of any of a plurality of jobs having different job medium width sizes, the controller applies the adjustment of the image print position similarly to a job having the same job medium width size as that subjected to the adjustment.

4. The image forming apparatus according to claim 3, wherein, when adjusting the image position in a top job with a job medium width size among the plurality of jobs having the different job medium width sizes, the controller applies the adjustment of the image print position similarly to a job in which the job medium width size different from a fed medium size is specified.

5. The image forming apparatus according to claim 1, wherein the controller manages transfer medium information in which the fed medium width size is set.

6. The image forming apparatus according to claim 1, wherein when the controller cancels the printing, a notification email is sent.

7. An image forming method using an image forming apparatus equipped with: an image former that forms an image on a continuous transfer medium on the basis of image data of a job; a controller that manages the job and controls the image former; and an operation display controlled by the controller and that accepts an operational input, the method comprising using the controller to:

compare a job medium width size specified in the job with a fed medium width size used in printing, when determining that the job medium width size is smaller than the fed medium width size based on the result of the comparing, display a setting screen including an item for setting an image print position on the continuous transfer medium on the operation display, and adjust the image print position to any of a plurality of positions in a width direction on the continuous transfer medium based on the operational input, when adjusting the image print position, cause the image former to print, on paper having the fed medium width size, the image of the job in which the job medium width size is specified, when determining that the job medium width size is larger than the fed medium width size based on the result of the comparing, cancel printing of the job and erasing the job, after displaying the setting screen on the operation display and setting the image print position, cause the image former to form the image based on the job that specifies the job medium width size smaller than the fed medium width size, and after forming the image based on the job that specifies the job medium width size smaller than the fed medium width size, cause the image former to form, without displaying the setting screen, another image based on another job that specifies a job medium width size that is same as the fed medium width size or same as the job medium width size specified in an immediately previous job.

8. A non-transitory recording medium storing a computer readable control program executed by an image forming apparatus equipped with: an image former that forms an image on a continuous transfer medium on the basis of image data of a job; a controller that manages the job and controls the image former; and an operation display controlled by the controller and that accepts an operational input, or executed by a management device that manages the image forming apparatus, the program comprising causing the controller to:

compare a job medium width size specified in the job with a fed medium width size used in printing, when determining that the job medium width size is smaller than the fed medium width size based on the result of the comparing, display a setting screen including an item for setting an image print position on the continuous transfer medium on the operation display, and adjust the image print position to any of a plurality of positions in a width direction on the continuous transfer medium based on the operational input, when adjusting the image print position, cause the image former to print, on paper having the fed medium width size, the image of the job in which the job medium width size is specified, when determining that the job medium width size is larger than the fed medium width size based on the result of the comparing, cancel printing of the job and erasing the job, after displaying the setting screen on the operation display and setting the image print position, cause the image former to form the image based on the job that specifies the job medium width size smaller than the fed medium width size, and after forming the image based on the job that specifies the job medium width size smaller than the fed medium width size, cause the image former to form, without displaying the setting screen, another image based on another job that specifies a job medium width size that is same as the fed medium width size or same as the job medium width size specified in an immediately previous job.

9. An image formation management system that manages an image forming apparatus equipped with: an image former that forms an image on a continuous transfer medium on the basis of image data of a job; a controller that manages the job and controls the image former; and an operation display controlled by the controller and that accepts an operational input, the system comprising:

a management controller that manages the image forming apparatus, wherein the management controller causes the controller to compare a job medium width size specified in the job with a fed medium width size used in printing, when the controller determines that the job medium width size is smaller than the fed medium width size based on the result of the comparison, the management controller causes the controller to display a setting screen including an item for setting an image print position on the continuous transfer medium on the operation display, and adjust the image print position to any of a plurality of positions in a width direction on the continuous transfer medium based on the operational input, when adjusting the image print position, the controller causes the image former to print, on paper having the fed medium width size, the image of the job in which the job medium width size is specified, when the controller determines that the job medium width size is larger than the fed medium width size based on the result of the comparison, the management controller causes the controller to cancel printing of the job and erase the job, and the management controller causes the controller to:

after displaying the setting screen on the operation display and setting the image print position, cause the image former to form the image based on the job that specifies the job medium width size smaller than the fed medium width size, and after forming the image based on the job that specifies the job medium width size smaller than the fed medium width size, cause the image former to form, without displaying the setting screen, another image based on another job that specifies a job medium width size that is same as the fed medium width size or same as the job medium width size specified in an immediately previous job.

* * * * *